United States Patent [19]

Halabisky et al.

[11] Patent Number: 4,690,835

[45] Date of Patent: Sep. 1, 1987

[54] REINFORCED CONTAINER

[75] Inventors: Donald D. Halabisky, Tacoma; Dwight A. Dudley, II, Federal Way, both of Wash.

[73] Assignee: Weyerhaeuser Company, Tacoma, Wash.

[21] Appl. No.: 825,125

[22] Filed: Feb. 3, 1986

Related U.S. Application Data

[62] Division of Ser. No. 616,464, Jun. 1, 1984, Pat. No. 4,586,643.

[51] Int. Cl.[4] ..... B05D 3/12; B05D 5/00

[52] U.S. Cl. ..... 427/210; 427/264; 427/293

[58] Field of Search ..... 229/3.1; 427/264, 265, 427/293, 210; 118/40, 44

[56] References Cited

U.S. PATENT DOCUMENTS

| | | | |
|---|---|---|---|
| 2,676,745 | 9/1945 | Geisler | 229/16 |
| 3,137,436 | 6/1964 | Moors et al. | 229/48 |
| 3,207,410 | 9/1965 | Dobbins et al. | 229/3.1 |
| 3,245,601 | 4/1966 | Hawkins | 229/3.1 |
| 3,263,891 | 8/1966 | Brugh, Jr. | 229/3.1 |
| 3,305,383 | 2/1967 | Gordy | 428/485 |
| 3,355,081 | 11/1967 | Kachurchak | 229/14 |
| 3,365,111 | 1/1968 | McNair, Jr. et al. | 229/17 |
| 3,421,678 | 1/1969 | Thompson et al. | 229/3.1 |
| 3,454,207 | 7/1969 | Jackson | 229/3.1 |
| 3,482,278 | 12/1969 | Thompson et al. | 425/113 |
| 3,498,527 | 3/1970 | Moors et al. | 229/17 G |
| 3,913,825 | 10/1975 | Brownlee et al. | 229/38 |
| 3,913,826 | 10/1975 | Brownlee et al. | 229/38 |
| 4,211,339 | 7/1980 | Itoh | 229/3.1 |
| 4,489,112 | 12/1984 | Wise et al. | 229/3.1 |

FOREIGN PATENT DOCUMENTS

| | | |
|---|---|---|
| 948279 | 1/1964 | United Kingdom . |

*Primary Examiner*—Evan K. Lawrence

[57] ABSTRACT

A process of reinforcing a polyethylene coated blank in which a reinforcing stripe is applied to a polyethylene coated web along a longitudinal score line which is to be scored. The web is thereafter scored along the line and the blank is cut from the web. The reinforcing stripe has a major portion of polyethylene, a small amount of vinyl acetate and a polypropylene/-polyisobutylene copolymer. During the application, the stripe material has a viscosity of 18,000–26,000 centipoise.

6 Claims, 8 Drawing Figures

120
12
21
13
22
20
15
23
16
121
130
122
123
124
125
126
127
131
128
129
140
27
105
114
91
90
103
100
107
110
113
95
98
101
92
93
94
108
112
96
102
99
104
26
106
111
109
71
79
78
77
81
72
73
74
75
76
80
25
70
41
47
53
55
64
60
63
48
51
50
42
43
57
44
58
62
40
45
46
49
52
54
24
56
61
59
30
31
32
33
34

REINFORCED CONTAINER

This is a division of application Ser. No. 616,464, filed June 1, 1984, now U.S. Pat. No. 4,586,643.

BACKGROUND OF THE INVENTION

There have been two problems with polyethylene coated liquid containing containers. These problems are the carton leaking and the side walls of the carton bulging over time. The first of these, the leaking, is created by cracks or tears in the carton which allows the liquid to leak out. The second of these, the bulging, is caused by the paperboard between the plastic liners taking up the liquid causing it to lose strength.

One of the standard methods of overcoming this problem was to use thicker layers of polyethylene on the paperboard. This was both to reduce the pinholes in the plastic which allow liquid to enter the paperboard and to prevent tearing or splitting of the polyethylene coating.

Over the years there have been a number of other solutions proposed.

Dobbins, et al., U.S. Pat. No. 3,207,410 discloses a multipiece container in which the fiber side wall is coated with a thin film 42 of thermoplastic resin, preferably polyethylene. When the container is assembled, the interior is flushed and given a thin wax coating 50. The wax coating drains down the side wall before solidifying and provides a liquid proof end seam of improved strength between the side wall and base.

Gordy, U.S. Pat. No. 3,305,383 discloses leakage along score lines at or adjacent to the bottom of the container and suggests impregnating a flat carton blank at certain confined areas with a normally solid hydrophobic material, such as various waxes. The critical areas are the areas along the bend or score lines at the bottom of the carton and extending up the sides. The wax or water resistant material is applied to the side of the flat blank which will become the inside of the carton. The outside of the blank may also be treated. The substrate may then be heated to facilitate penetration of the water resistant material into the stock. The substrate is then coated with the polyethylene thermoplastic resin.

McNair, Jr., et al., U.S. Pat. No. 3,365,111 discloses applying a hot melt after the container is formed. The hot melt may be applied either to the center of the bottom closure structure as in FIG. 5A or over the entire area of the bottom closure as in FIG. 5B.

Thompson, et al., U.S. Pat. Nos. 3,421,678 and 3,482,278 are exemplary of several that disclose the application of a variable thickness polyethylene coating to the paperboard substrate prior to the formation of a carton. This results in a coating thinner than normal in the upper portion of the carton and thicker than normal in the lower portion of the carton. FIG. 3 of U.S. Pat. No. 3,421,678 shows paperboard having the variable thickness interior polyethylene film in cross section.

The Brownlee, et al. U.S. Pat. Nos. 3,913,825 and 3,913,826 disclose other methods of improving the bottom of the paperboard container to make it leak proof. U.S. Pat. No. 3,913,826 discloses a continuous thermoplastic band 92 along the bottom edge of the blank which melts and seals the edges of the bottom closure together when the container is formed. The band 92 may be replaced by discontinuous bands 93-96 which seal the major leakage channel when the container is erected and heat sealed. The thermoplastic must adhere to polyethylene and have a melt index of 3.0-300. Stein Hall LHM 597 is recommended.

U.S. Pat. No. 3,913,826 discloses thermoplastic patches 86, 87, 90 and 91 which form melted patch 99 when the container is erected and heat sealed. Again the thermoplastic must adhere to polyethylene and have a melt index of 3.0-300. Dupont Surlyn AD 8109 and polyethylene are recommended.

Geisler, U.S. Pat. No. 2,676,745 discloses treating the score lines of a corrugated container with a solution of latex and sodium silicate to toughen them.

Kachurchak, U.S. Pat. No. 3,355,081 discloses placing a plastic strip on the interior of the container so that when the container is slit with a knife, the knife will enter the strip and not cut the material contained within the container. The strip is resilient and has high strength. It may be nylon, polyethylene, polypropylene or any other molded or extruded plastic.

British Pat. No. 948,279 discloses a cardboard blank in which the interior is coated with polyethylene or polypropylene. The coating is thicker in the areas in which the blank is to be heat sealed than in the areas where it is not to be heat sealed.

Hawkins, U.S. Pat. No. 3,245,601 discloses a patterned coating on the substrate.

Moors, et al. U.S. Pat. No. 3,137,436 discloses a milk carton in which the vertical score lines are covered and reinforced with a varnish. The varnish may be a nitrocellulose varnish, an acrylic varnish or a polyvinyl chloride varnish. The container is formed and then the interior walls are coated with wax.

In another development in the early 1960s, a milk carton was reinforced along the score lines with an Elvax material having a viscosity of from 75,000 to 100,000 cp. The entire board was then coated with an Elvax composition having a viscosity of less than 75,000 cp.

In each of the above constructions the paperboard itself is coated with the reinforcing material and then the additional coating, usually of wax, is placed over the reinforcing material.

SUMMARY OF THE INVENTION

The inventors wished to develop a process to reduce the amount of polyethylene being coated on the paperboard substrate while maintaining or reducing the number of containers which might leak or the amount of bulge in the container. They decided to apply a reinforcing stripe to a polyethylene coated web along a longitudinal score line to be scored, scoring the web along the line and cutting a blank from the web. It was their view that there were a number of service requirements for the material being used for the reinforcing stripe. It must be compatible with the polyethylene coating. It must be able to stick to the polyethylene. It must be able to be placed on the polyethylene container within the existing process. It must have a quick cure time because in the standard forming operation there is not much time between the blank coming into the system and being formed. They decided that a half second cure time was the maximum allowable. It must be nonflammable because there are flame sealers used in the process of forming the tubular milk container. It must be easy to apply because the liner is moving at about 600 feet a minute. It should also be a resin that does not activate.

The inventors discovered that resins having a major portion of polyethylene, a small amount of vinyl acetate and a polypropylene/polyisobutylene copolymer met the criteria. Three particular resins met the criteria. These resins had viscosities of from 18,000 to 26,000 cp. The first resin had 75–85% polyethylene, a small amount of vinyl acetate, as either polyvinyl acetate or ethyl vinyl acetate, and the remainder polypropylene/-polyisobutylene copolymer. The second resin had the same constituents but there was only 65–75% polyethylene, less vinyl acetate and more polypropylene/-polyisobutylene copolymer. The third was a 50%/50% blend of the first two.

DESCRIPTION OF THE PREFERRED EMBODIMENT

Figure 1:
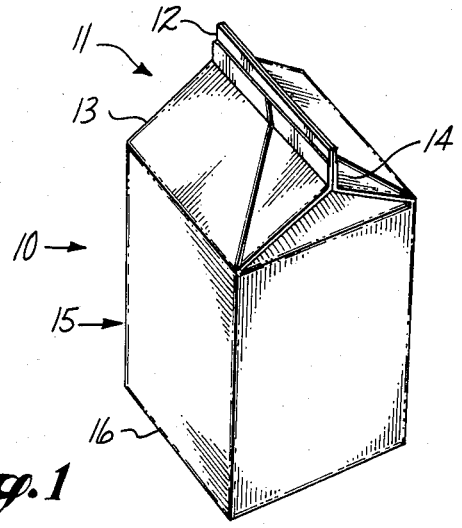
FIG. 1 is an isometric view of a milk carton.

FIG. 1 shows a milk carton 10 having an upper closure section 11, a side panel section 15 and a bottom closure section 16. The upper closure section 11 is divided into an upper sealing section 12 and a gable section 13. One side of the upper closure section 11 forms a pour spout section 14.

Figure 2:
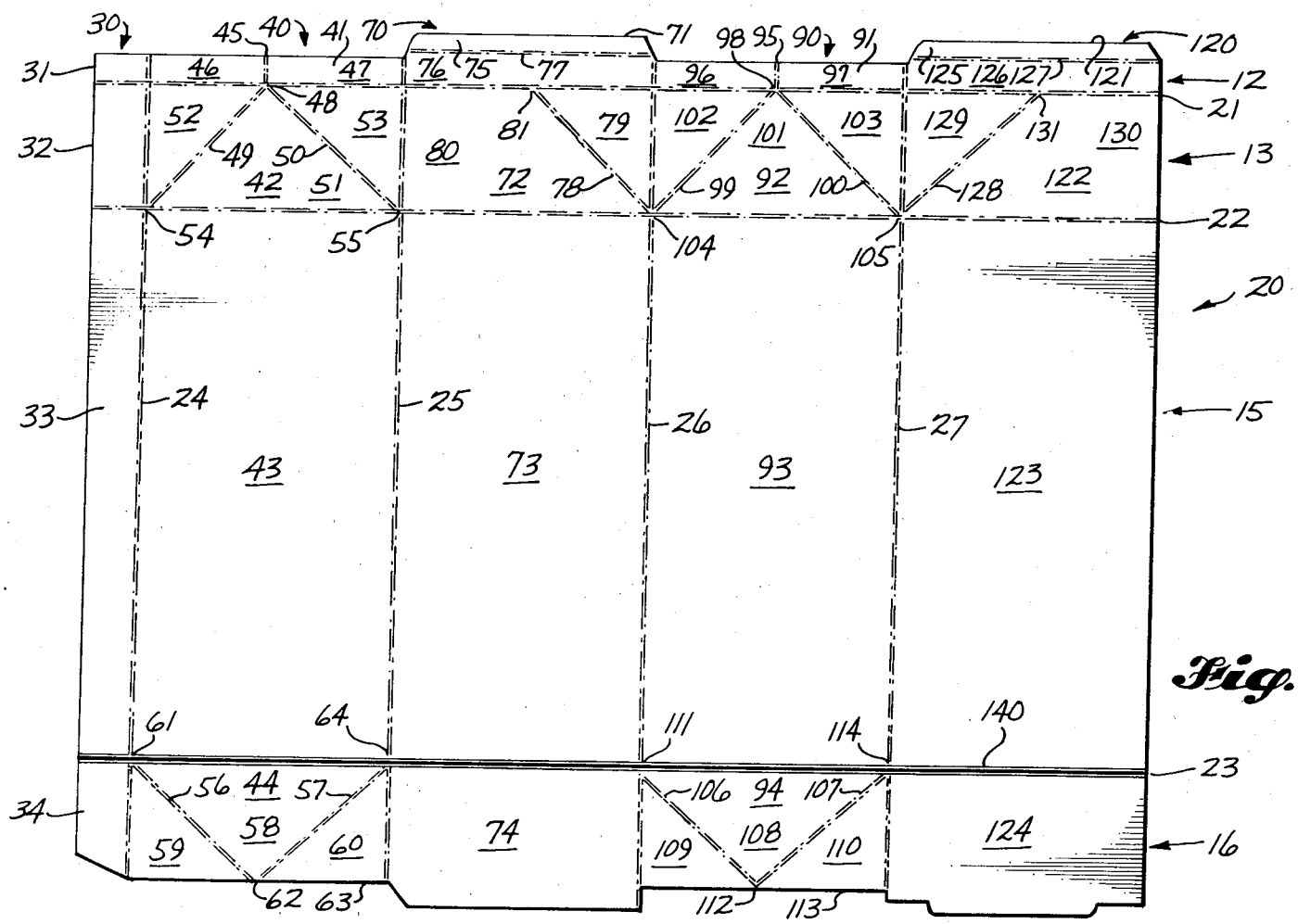
FIG. 2 is a top plan view of a milk carton blank showing the inner face of the blank with a reinforcing stripe on the bottom horizontal score line.

The blank for the container of FIG. 1 is shown in FIG. 2. The blank 20 is divided by longitudinal score lines 21, 22 and 23 into the upper sealing section 12, the gable section 13, the side panel section 15 and the bottom closure section 16. The blank 20 is also divided by transverse score lines 24, 25, 26 and 27 into a first panel section 30, a second panel section 40, a third panel section 70, a fourth panel section 90 and a fifth panel section 120.

The longitudinal score lines 21, 22 and 23 divide the first panel section 30 into a first sealing panel 31, a first gable panel 32, a first side panel 33 and a first bottom closure panel 34; the second panel section 40 into a second sealing panel 41, a second gable panel 42, a second side panel 43 and a second bottom closure panel 44; the third panel section 70 into a third sealing panel 71, a third gable panel 72, a third side panel 73 and a third bottom closure panel 74; the fourth panel section 90 into a fourth sealing panel 91, a fourth gable panel 92, a fourth side panel 93 and a fourth bottom closure panel 94; and the fifth panel section 120 into a fifth sealing panel 121, a fifth gable panel 122, a fifth side panel 123, and a fifth bottom closure panel 124.

The second and fourth sealing panels 41 and 91 are divided by transverse score line into two equal sealing panel sections. The second sealing panel 41 is divided by a transverse score line 45 into second sealing panel sections 46 and 47. The transverse score line 45 intersects longitudinal score line 21 at 48. The fourth sealing panel 91 is divided by transverse score line 95 into fourth sealing panel sections 96 and 97. The transverse score line 95 intersects the longitudinal score line 21 at 98.

The second and fourth gable panels 42 and 92 are divided by two oblique score lines into a central triangular section and two right triangular sections on each side of the central triangular section. The second gable panel 42 is divided by score lines 49 and 50 into a central triangular section 51 and two side right triangular sections 52 and 53. The score line 49 extends from the inner corner 54 of gable panel 42 to the intersection 48 of score lines 45 and 21. The score line 50 extends from the other inner corner 55 of gable panel 42 to the central point 48. The fourth gable panel 92 is divided by score lines 99 and 100 into a central triangular section 101 and two side right triangular sections 102 and 103. The score line 99 extends from the inner corner 104 of gable panel 92 to the intersection 98 of score lines 95 and 21. The score line 100 extends from the other inner corner 105 of gable panel 92 to the intersection 98.

The second and fourth bottom closure panels 44 and 94 are also divided by a pair of oblique score lines into a central triangular section and a right triangular section on each side of the central triangular section. The second bottom closure panel 44 is divided by score lines 56 and 57 into a central triangular section 58 and two side right triangular sections 59 and 60. The score line 56 extends from an inner corner 61 of bottom closure panel 44 to a central point 62 on the outer edge 63 of the bottom closure panel 44. The score line 57 extends from the other inner corner 64 of bottom closure panel 44 to the central point 62. The fourth bottom closure panel 94 is divided by score lines 106 and 107 into a central triangular section 108 and two side right triangular sections 109 and 110. The score line 106 extends from the inner corner 111 of bottom closure panel 94 to the central point 112 on the outer edge 113 of the bottom closure panel 44. The score line 107 extends from the other inner corner 114 of bottom closure panel 94 to the central point 112.

The third and fifth sealing panels 71 and 121 are divided into an inner sealing panel and an outer sealing panel by a longitudinal score line. The third sealing panel 71 is divided into an outer sealing panel 75 and an inner sealing panel 76 by longitudinal score line 77 and the fifth sealing panel 121 is divided into an outer sealing panel 125 and an inner sealing panel 126 by longitudinal score line 127. The longitudinal score lines 77 and 127 are aligned with each other and also with the outer edge of the first sealing panel 31, second sealing panel 41 and fourth sealing panel 91.

The third and fifth gable panels 72 and 122 are divided by an oblique score line into a right triangular section and a trapezoidal section. The third gable panel 72 is divided by an oblique score line 78 into a right triangular section 79 on one side of the gable panel 72 and a trapezoidal section 80 forming the rest of the gable panel 72. The oblique score line 78 extends from inner corner 104 to the center point 81 on the outer edge of the gable panel 72. The center point 81 is on score line 21. The fifth gable panel 122 is divided by oblique score line 128 into a side right triangular section 129 and a trapezoidal section 130. The score line 128 extends from the inner corner 105 of the gable panel 122 to the center point 131 on the outer edge of the gable panel 122. The center point 131 is on score line 21.

The third and fifth bottom closure panels 74 and 124 are longer than the remaining bottom closure panels to allow sealing of the bottom closure.

The tubular container is formed by adhering the first panel section 30 to the fifth panel section 120. The polyethylene coating on the container is heated and the soft polyethylene is adhered together.

The bottom closure is formed by folding the second and fourth bottom closure panels 44 and 94 inwardly. The right triangular sections 59 and 60 fold under the central triangular section 58 and the right triangular sections 109 and 110 fold under the central triangular section 108. The third and fifth bottom closure panels 74 and 124 are under the bottom closure panels 44 and 94. The polyethylene coating on the panels is then heated and the panels are adhered together.

The upper closure panel 11 is formed by folding the second and fourth upper sealing panels 41 and 91 inwardly at transverse score lines 45 and 95. This action draws in the second and fourth gable panels 42 and 92, and the third and fifth gable panels 72 and 122. The central triangular panels 51 and 101 bend inwardly around sum lines 22, and the triangular panels 52, 53, 102 and 103 bend around score lines 49, 50, 99 and 100 respectively until the panels are contiguous with the gable panels 72 and 122. The sealing panel sections 46, 47, 96 and 97 are also contiguous with sealing panels 76 and 126. The score lines 78 and 99, and 100 and 128 are aligned. The sealing panels are then heated and the polyethylene in the sealing panels adhere the panels together.

The fourth sealing panel 91 and gable panel 92, as well as the right triangular panels 79 on gable panel 72 and 129 on gable panel 122 form the pour spout section. There are abhesives on the sealing panels in this section to allow an easier opening of the container.

Both faces of the paperboard substrate are covered with a polyethylene material. Usually the inner face has a thicker coating of polyethylene than the outer face. There may also be foil between the polyethylene and the paperboard.

In order to prevent leakage in the container the third longitudinal score line 23 is coated with a reinforcing material 140.

This reinforcing material should be a hot melt material that is compatible with polyethylene, is quickly cured, has a high melt temperature, is nonflammable, has a reactivation temperature of at least 220°-280° F., sticks to polyethylene, and is flexible.

Three materials have been tried and each meets these requirements. All are three-component hot melt resins that contain polyethylene as the main component, vinyl acetate—either polyvinyl acetate or ethyl vinyl acetate—as a minor component, and a polypropylene/-polyisobutylene copolymer as the third component.

The first is a hot melt resin that contains 75-85% polyethylene, a small amount of vinyl acetate, either polyvinyl acetate or ethyl vinyl acetate, and the remainder a polypropylene/polyisobutylene copolymer. This is sold by Bostik as No. 827-548. Its viscosity is around 18,000 cp.

The second is a hot melt resin that contains 65-75% polyethylene, a very small amount of vinyl acetate, either polyvinyl acetate or ethyl vinyl acetate, and the remainder the polypropylene/polyisobutylene copolymer. There is less vinyl acetate in this mixture than in the previous mixture.

The third is a 50%/50% mixture of the first two resins.

Quart and half gallon milk cartons were manufactured. In each size there was a control group having no reinforcing on score line 23 and a test group having a reinforcing stripe 140 on the score line 23. In the quart size, the control group was Examples 1-2 and the test group was Examples 3-8. In the half-gallon size, the control group was Examples 9-10 and the test group was Examples 11-13. In both groups the thickness of the polyethylene film on the entire carton was varied and in the test group the thickness of the reinforcing stripe was varied. Table I gives the different film weights and stripe thicknesses for the quart size containers and Table III gives the different film weights and stripe thicknesses for the half gallon size containers.

The containers were filled with water, sealed and stored and checked for leakage and for side wall bulge.

In the quart size both the control and test groups were checked for leaking containers after four and seven days. In the half gallon size the control and test groups were checked after four days. The results of these tests are given in Table I for the quart size containers and in Table III for the half gallon size containers.

In both sizes both the control and test groups were checked for side wall bulge after the initial filling and after seven days. The results of these tests are given in Table II for the quart size and in Table IV for the half gallon size containers.

TABLE

| | Film Weight | | Stripe | | | % Leaks | |
|---|---|---|---|---|---|---|---|
| | | | Hot | Thickness | | 4 | 7 |
| Ex. | g/m² | lbs/rm | Melt | mm | mils | Days | Days |
| 1 | 26.2 | 16.1 | — | — | — | 9.3 | 55.2 |
| 2 | 16.7 | 10.3 | — | — | — | 31.9 | 51.3 |
| 3 | 17.2 | 10.6 | 1 | 0.12 | 5.0 | 17.9 | 43.7 |
| 4 | 16.4 | 10.1 | 1 | 0.10 | 4.1 | 20.2 | 20.7 |
| 5 | 16.7 | 10.3 | 2 | 0.04 | 1.7 | 29.7 | 46.0 |
| 6 | 16.1 | 9.9 | 2 | 0.05 | 2.0 | 31.0 | 54.2 |
| 7 | 16.6 | 10.2 | 3 | 0.08 | 3.0 | 6.0 | 47.7 |
| 8 | 16.7 | 10.3 | 3 | 0.09 | 3.5 | 36.9 | 50.0 |

Hot Melt:
1 75-85% Polyethylene Small amount vinyl acetate (either polyvinyl or ethyl vinyl acetate) Remainder polypropylene/polyisobutylene copolymer
2 65-75% Polyethylene Very small amount vinyl acetate (either polyvinyl or ethyl vinyl acetate) Remainder polypropylene/polyisobutylene copolymer
3 50%/50% blend of 1 and 2

TABLE II

| | Bulge | | | | | |
|---|---|---|---|---|---|---|
| | mm | | | mils | | |
| Ex. | Init. | 7 Days | Incr. | Init. | 7 Days | Incr. |
| 1 | 0.3 | 7.8 | 7.5 | 1.3 | 30.6 | 29.4 |
| 2 | 0.5 | 8.7 | 8.3 | 1.9 | 34.4 | 32.5 |
| 3 | 1.0 | 9.5 | 8.6 | 3.8 | 37.5 | 33.8 |
| 4 | 0.8 | 9.1 | 8.3 | 3.1 | 35.9 | 32.8 |
| 5 | 0.4 | 9.1 | 8.7 | 1.5 | 35.9 | 34.4 |
| 6 | 0.6 | 9.4 | 8.7 | 2.5 | 36.9 | 34.4 |
| 7 | 1.0 | 9.4 | 8.4 | 3.8 | 36.9 | 33.1 |
| 8 | 1.0 | 9.8 | 8.8 | 3.8 | 38.4 | 34.7 |

TABLE III

| | Film Weight | | Stripe | | | % Leaks |
|---|---|---|---|---|---|---|
| | | | Hot | Thickness | | 4 |
| Ex. | g/m² | lbs/rm | Melt | mm | mils | Days |
| 9 | 25.5 | 15.7 | — | — | — | 35.0 |

TABLE III-continued

| Ex. | Film Weight g/m² | Film Weight lbs/rm | Stripe Hot Melt | Stripe Thickness mm | Stripe Thickness mils | % Leaks 4 Days |
|---|---|---|---|---|---|---|
| 10 | 26.8 | 16.5 | — | — | — | 50.1 |
| 11 | 19.7 | 12.1 | 3 | 0.05 | 2.0 | 29.4 |
| 12 | 21.6 | 13.3 | 3 | 0.06 | 2.3 | 43.6 |
| 13 | 27.0 | 16.6 | 3 | 0.06 | 2.5 | 38.7 |

TABLE IV

| Ex. | Bulge mm Init. | Bulge mm 7 Days | Bulge mm Incr. | Bulge mils Init. | Bulge mils 7 Days | Bulge mils Incr. |
|---|---|---|---|---|---|---|
| 9 | 3.6 | 10.3 | 6.7 | 14.2 | 40.8 | 26.4 |
| 10 | 4.1 | 10.6 | 6.4 | 16.1 | 41.7 | 25.2 |
| 11 | 3.6 | 12.1 | 8.7 | 14.2 | 47.6 | 34.3 |
| 12 | 4.1 | 12.1 | 8.0 | 16.1 | 47.6 | 31.5 |
| 13 | 4.6 | 10.9 | 6.3 | 18.1 | 42.9 | 24.8 |

The bulge did increase in both the half gallon and quart containers, but the average film weight decreased 29% in the quart containers and 15% in the half gallon containers. This caused an increase in container wall moisture pickup. The bulge increase was minimal. In the quarts the average bulge increase was 0.7 mm, and in the half gallons the average bulge increase was 1.1 mm. This is comparable to the bulge in variable thickness side wall coatings of polyethylene.

Figure 3:
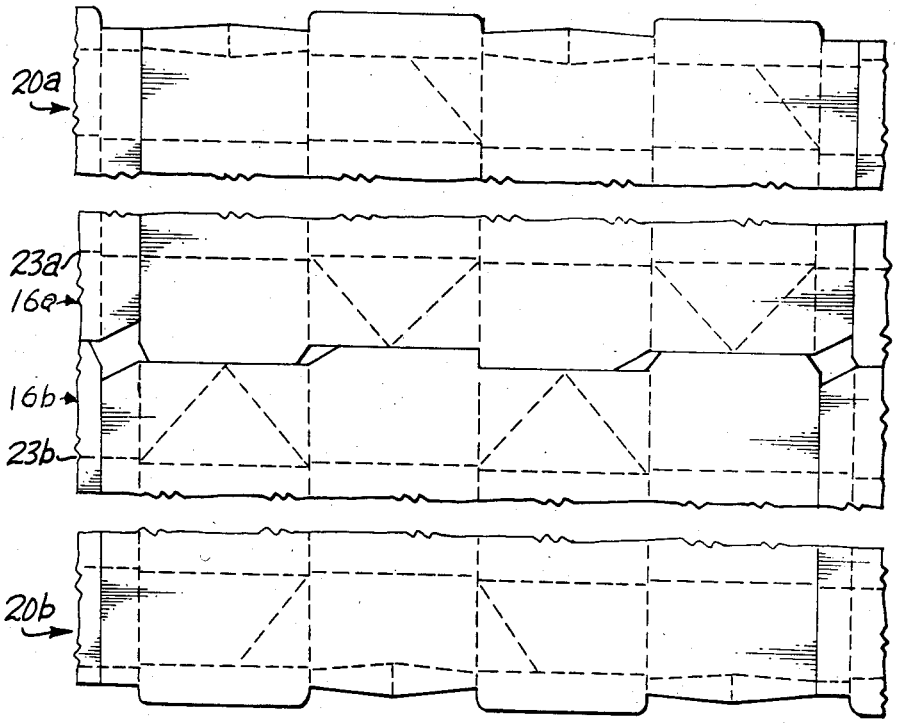
FIG. 3 is a top plan view of a paperboard web showing the container blanks nested in the web.

FIG. 3 shows a web in which two milk carton blanks 20*a* and 20*b* are nested together along the bottom closure sections 16*a* and 16*b*. The third longitudinal score lines 23*a* and 23*b* are close together. It is easy to coat these score lines with the reinforcing material 140 on the inner face of the container.

Figure 4:
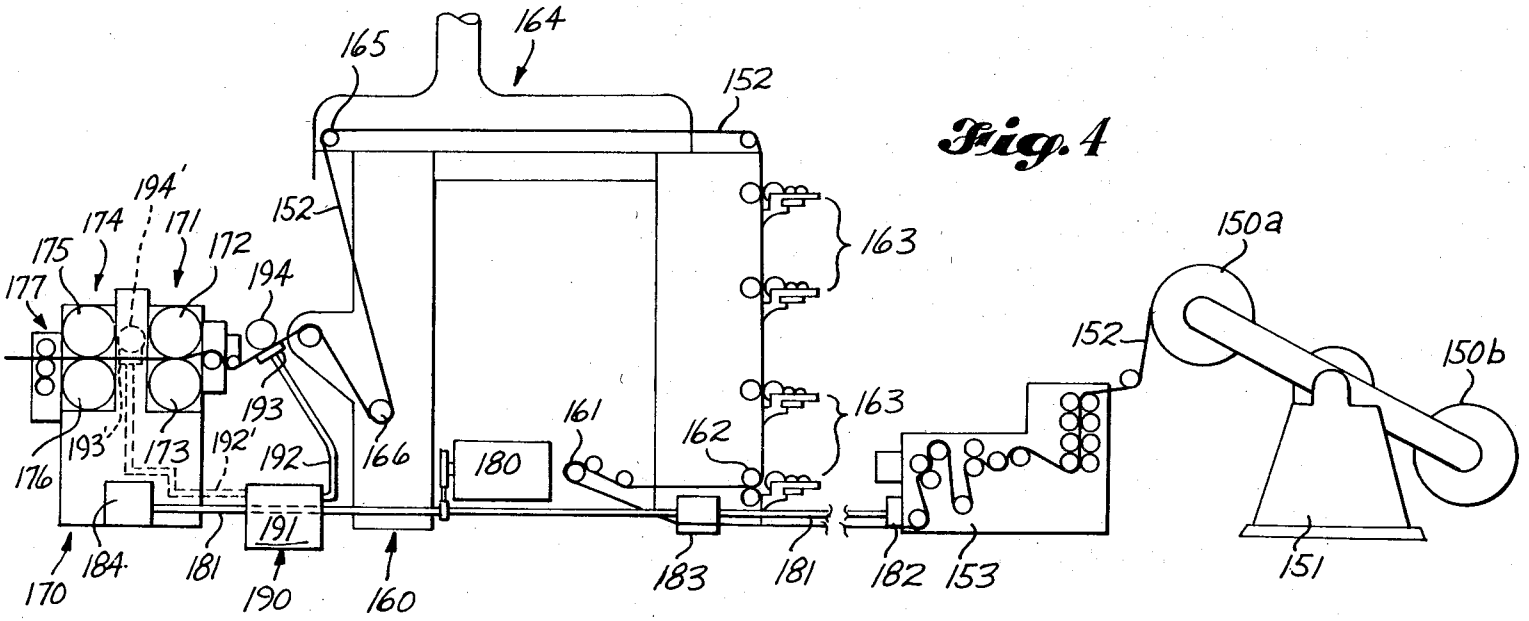
FIG. 4 is a diagram in side view of a printing, scoring and cutting apparatus for forming milk carton blanks from a web of polyethylene coated paperboard.
Figure 6:
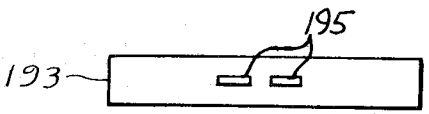
FIG. 6 is a top plan view of the applicator head.
Figure 5:
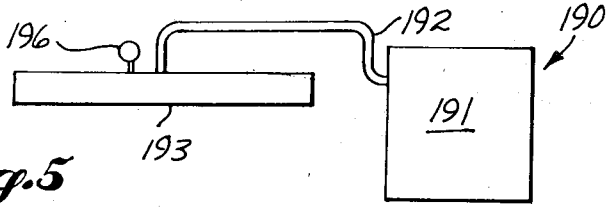
FIG. 5 is a diagram in front view of the hot melt applicator.

FIGS. 4–6 show the milk carton printing and cutting equipment with the reinforcing applicator in place. Two rolls of polyethylene coated paperboard 150*a* and 150*b* are on the roll stand 151. The web 152 from roll 150*a* first passes through roll splicer 153 which is used to splice together the trailing end of the web from one roll with the leading end of the web from the next roll when the transfer is made from one roll to the other.

The web then passes through the printing tower 160 where illustrations are printed on the polyethylene coated web. The web 152 first passes over the steering roll 161 which aligns the web for passing through the printing tower. It then passes over the nip drive roll 162 and through the printing decks 163. Four printing decks are shown. Each will print a separate color on the web. The printed web is then passed through the web dryer 164 which dries the ink on the web, around a second steering roll 165 and then past the lipper drive 166.

The printed web 152 then passes through the scoring and cutting station 170. The web first passes through the scoring station 171 which has a male scoring head 172 on the outer printed face of the web and the female scoring head 173 on the inner unprinted face of the web. These place the score lines on the individual blanks. The blanks are then cut from the web in the cutting station 174. The cutting head 175 has dies that cut the blank. The smooth roll 176 holds the web against the cutting head. The web then passes through the pinstripper 177 which removes the blanks from the web.

The apparatus is driven by the main drive motor 180 which operates the drive line 181. This in turn operates a gear box 182 in the roll splicer 153, a right angle gear box 183 on the printing tower 160 and a gear box 184 on the scoring and cutting station 170.

The hot melt unit 190 is shown between the printing tower 160 and the scoring and cutting station 170. There should be enough distance between the hot melt applicator and the following unit to allow the hot melt resin to cure before entering the next station. A distance of 5 or 6 feet is considered to be adequate. If necessary, additional curing equipment such as an air jet can be used to speed up the curing.

The hot melt unit has a heating unit 191 and a hot melt hose 192 and an applicator head 193. A backup roll 194 is placed opposite the applicator head on the opposite face of the web. The applicator head 193 will have a slot for each of the lines of reinforcing material to be placed on the web. In the present application reinforcing material will be placed on longitudinal score lines 23*a* and 23*b* so two slots 195 are shown in the applicator head. The applicator head also has a temperature gauge 196 to insure that the hot melt resin is at the appropriate temperature in the applicator head. A meltex CR-05 unit with a slot die coating head has been found to be acceptable for applying the reinforcing material to the web. An upwards application is shown; however, a downwards application is better.

The applicator head may also be between the scoring station 171 and cutting station 174 as shown in dotted line by hose 192', applicator head 193', and backup roll 194'. The spacing between the applicator head 193' and the cutting station 174 would allow the resin to cure.

Figure 7:
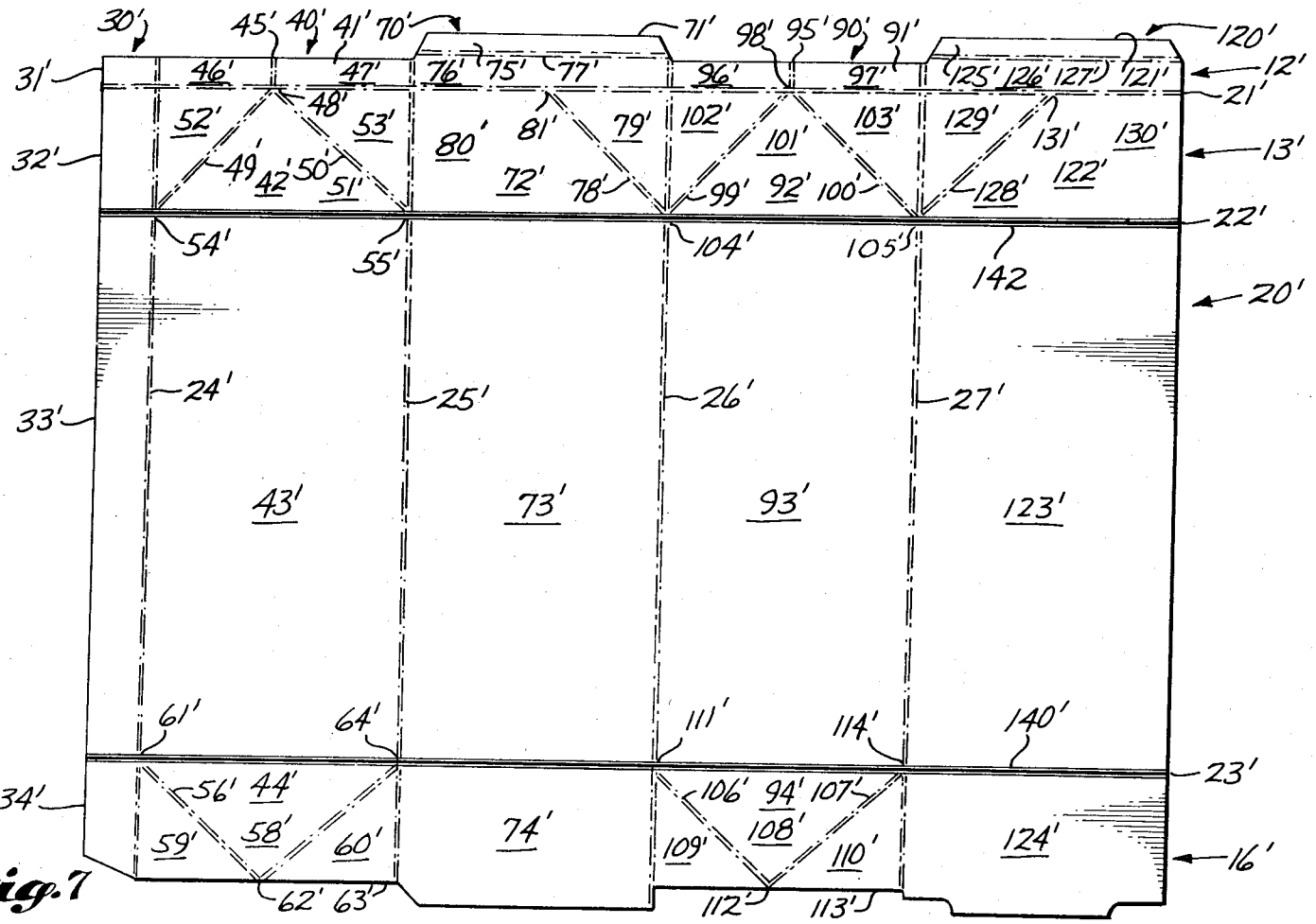
FIG. 7 is a top plan view of a milk carton blank showing the inner face of the blank with reinforcing stripes on the top and bottom side panel score lines.

In some applications it has been found advisable to place a reinforcing stripe on the second longitudinal score line 22 also. A blank having this additional reinforcing stripe 142 on longitudinal score line 22 is shown in FIG. 7. The other reference numerals in the drawing are the same as in FIG. 2. The four lines of reinforcing material will be applied by the same apparatus used for two reinforcing lines, except there will be four slots instead of two in the applicator head.

Figure 8:
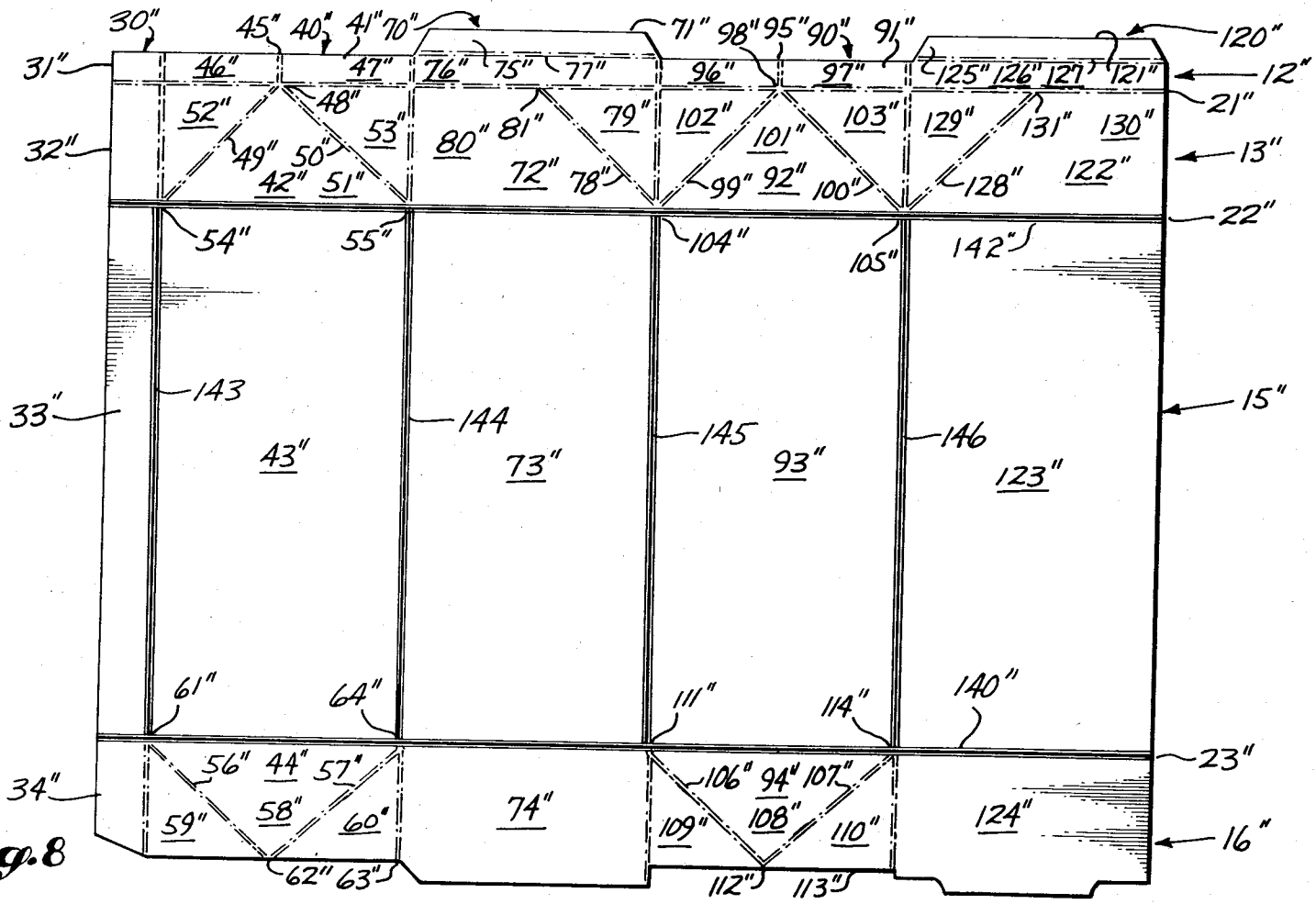
FIG. 8 is a top plan view of a blank for a milk carton showing the inner face of the blank with reinforcing stripes on the top, bottom and side score lines.

FIG. 8 shows a blank in which reinforcing stripes 143, 144, 145 and 146 has been placed on transverse score lines 24, 25, 26 and 27. The other reference numerals are the same as in FIG. 7. A rotogravure printing wheel is needed to put on the transverse reinforcing stripes.

What is claimed is:

1. The process of reinforcing a polyethylene coated blank comprising applying a reinforcing stripe to a polyethylene coated web along a longitudinal score line to be scored, said reinforcing stripe comprising essentially a major portion of polyethylene, a small amount of vinyl acetate and a polypropylene/polyisobutylene copolymer, scoring said web along said line, and cutting said blank from said web.

2. The process of claim 1 in which said polyethylene comprises

65–85% of the material in said reinforcing stripe.

3. The process of reinforcing a polyethylene coated container blank comprising applying a reinforcing stripe to a polyethylene coated web along a longitudinal line to be scored, said stripe being applied at a viscosity of 18,000–26,000 centipoise, scoring said web along said line, and cutting said blank from said web.

4. The process of reinforcing a polyethylene coated container blank comprising printing with ink a design on the outer face of a polyethylene coated web containing said blank, drying said ink, applying a reinforcing stripe to the inner face of said polyethylene coated web along a longitudinal line to be scored, said reinforcing stripe comprising essentially a major portion of polyethylene, a small amount of vinyl acetate and a polyethylene/polyisobutylene copolymer, scoring said web along said line and cutting said blank from said web.

5. The process of claim 4 in which said polyethylene comprises 65–85% of the material in said reinforcing stripe.

6. The process of reinforcing a polyethylene coated container blank comprising printing with ink a design on the outer face of a polyethylene coated web containing said blank, drying said ink, applying a reinforcing stripe to the inner face of said polyethylene coated web along a longitudinal line to be scored, said reinforcing stripe being applied at a viscosity of 18,000–26,000 centipoise, scoring said web along said line and cutting said blank from said web.

* * * * *